United States Patent [19]

Byrd

[11] Patent Number: 4,610,447

[45] Date of Patent: Sep. 9, 1986

[54] JOGGER'S ROD

[76] Inventor: Betty L. Byrd, 18 N. Glenwood, Pontiac, Mich. 48058

[21] Appl. No.: 637,318

[22] Filed: Aug. 3, 1984

[51] Int. Cl.[4] ..... A63B 21/00

[52] U.S. Cl. ..... 272/70; 135/66; 206/37; 220/4 B; D3/48

[58] Field of Search ..... 272/70, 127, DIG. 9; 446/419, 421; 206/37, 38, 37.4, 234, 235, 236, 496; 220/4 B, 4 E; D3/30.1, 43, 48; 128/57; 135/65, 66

[56] References Cited

U.S. PATENT DOCUMENTS

| | | | |
|---|---|---|---|
| 122,218 | 12/1871 | Bogert | 135/66 X |
| 253,011 | 1/1882 | Crowley | 135/66 |
| 1,526,246 | 2/1925 | Simek | 135/66 X |
| 2,210,493 | 8/1940 | Lisi | 135/66 |
| 2,515,715 | 7/1950 | Jones | 220/4 E X |
| 2,682,904 | 7/1954 | Divine | 135/66 X |
| 2,742,956 | 4/1956 | Cannata | 135/66 X |
| 2,935,321 | 5/1960 | Lhotka | 273/67 R |
| 4,351,348 | 9/1982 | Axton | 135/66 |
| 4,393,974 | 7/1983 | Levesgue | 206/37 |

FOREIGN PATENT DOCUMENTS

| | | | |
|---|---|---|---|
| 2096005 | 10/1982 | United Kingdom | 272/127 |

*Primary Examiner*—Richard J. Apley
*Assistant Examiner*—David J. Brown
*Attorney, Agent, or Firm*—Basile, Weintraub & Hanlon

[57] ABSTRACT

A rod is disclosed for use by joggers and runners wherein the rod has a hollow body with opposing apertures permitting access to the interior of the body for the storage of personal items. The apertures are threaded to receive threaded arm members which extend outwardly and are grasped by a user during the act of jogging and/or running.

5 Claims, 3 Drawing Figures

JOGGER'S ROD

BACKGROUND OF THE INVENTION

I. Field of the Invention

The present invention relates to jogging equipment and, in particular, to a rod to aid persons who are running or jogging.

II. Description of the Prior Art

It has become quite common for individuals to take up the sports of running and jogging as these sports have provided individuals with a simple but enjoyable means of maintaining their physical well being. For many individuals jogging can be difficult as they lack a means which will create a rhythm of running and a systematic movement between the upper and lower portions of the body. In addition, today jogging and running suits, shorts, tops, sweatsuits and other appropriate apparel utilized by persons who are running and jogging generally have no pockets or have pockets which are not adapted to safely store items, such as one's driver's license and other valuable documents. Another major problem associated with jogging and running is the vulnerability of the runners and joggers to the possibility of an attack from a mugger or an animal, such as a stray dog.

It would therefore be desirable to provide a simple means which will afford joggers and runners an opportunity to develop the aforementioned rhythm of running, yet an item which can provide a convenience for storing necessary items, such as a driver's license and other paraphernalia, while at the same time providing the jogger or runner with a means for self protection.

SUMMARY OF THE INVENTION

The present invention, which will be described subsequently in greater detail, comprises a jogger's rod adapted to be carried by a person while jogging and/or running. The jogger's rod comprises an enlarged, hollow, spherically shaped body having diametrically opposed apertures which permit access to the interior of the body for the storage of items useful to a jogger. The apertures are threaded so as to receive, respectively, threaded ends of outwardly extending arms which are adapted to be held by the jogger.

It is therefore a primary object of the present invention to provide a rod particularly adapted for use by persons when jogging or running which will provide them with a simple means for carrying personal items, a source of personal protection and a means for obtaining a desired running rhythm.

Other objects, advantages and applications of the present invention will become apparent to those skilled in the art of jogging and running equipment when the accompanying description of one example of the best mode contemplated for practicing the invention is read in conjunction with the accompanying drawing.

BRIEF DESCRIPTION OF THE DRAWING

The description herein makes reference to the accompanying drawing wherein like reference numerals refer to like components throughout the several views, and wherein.

DESCRIPTION OF THE PREFERRED EMBODIMENT

Figure 1:
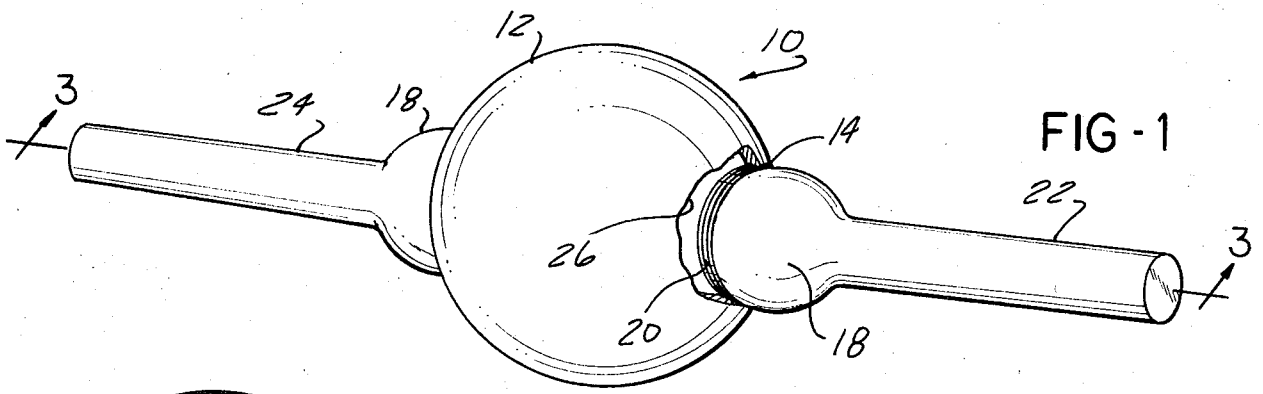
FIG. 1 is a partially sectioned, perspective view of a jogger's rod constructed in accordance with the principles of the present invention.
Figure 3:
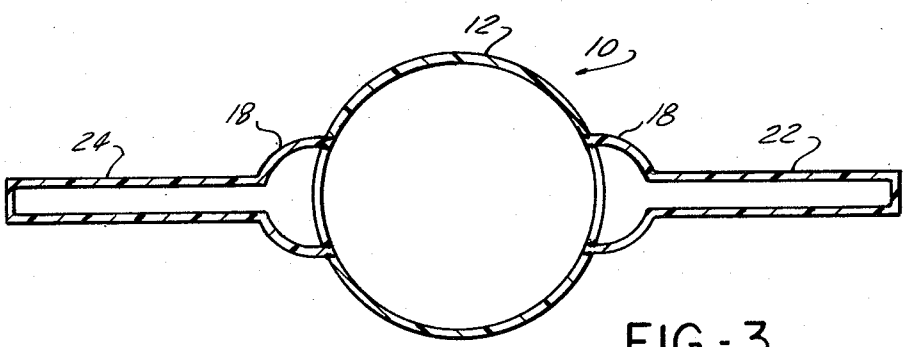
FIG. 3 is a cross sectional view of the jogger's rod illustrated in FIG. 1.
Figure 2:
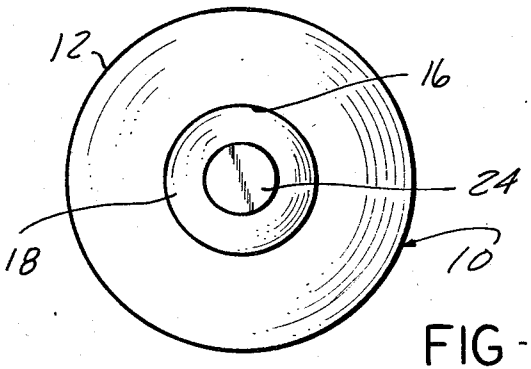
FIG. 2 is a left-side elevational view of the jogger's rod illustrated in FIG. 1.

The present invention, which will be described subsequently in greater detail, comprises a rod 10 which is preferably adapted to be carried by joggers and runners. The jogger's rod 10 has an enlarged, spherically shaped, hollow body 12 which, in turn, includes diametrically opposed apertures 14 and 16. As can best be seen in FIG. 1, the apertures 14 and 16 are threaded to receive in a conventional manner threaded ends 20 of a pair of arm members 22 and 24, respectively. The arm members are enlarged at the body engaging ends thereof as shown by an enlarged bulbous region at 18 and are narrowed down to a uniform thickness over the remaining thereof to provide on opposite ends of the rod arm members 22 and 24 a grasping handle for each hand of the jogger.

In the preferred embodiment, the body 12 is preferably eight inches in diameter with the apertures 14 and 16 being approximately four inches in diameter. The relative size between the apertures 14 and 16 and the body 12 and the hollow interior thereof is such that the body 12 defines a compartment 26 that may store any of the items that a jogger may wish to safely carry, such as an I.D., hospital registration card or the name and phone number of a person to contact in the event of an emergency, such as in the event of an automobile accident involving the jogger. In addition, small change, car keys, tissue, candy and other suitable materials can be easily stored within the body compartment 26.

The enlarged sections 18 of each of the arms 22 and 24 are approximately one inch long and are narrowed down to a uniform diametrical thickness of approximately one and one-half inches over a length of approximately eight inches. The overall length of the jogger's rod is therefore approximately two feet long and may be made of any desirable material, such as wood, plastic or hard rubber.

In use a jogger will grasp the arm members 22 and 24 about the handle portions and this tends to create a running rhythm and systematic movement between the upper and lower body portions when the jogger moves.

While jogging the rod 10 may be used as a means for protecting the jogger against stray animals as the jogger may grab one of the arm members 22 or 24 and use the rod 10 as a weapon, which also may effectively be used to protect the jogger against a possible mugger.

It can thus be seen that the present invention has provided a unique means for use by persons who are jogging and/or running wherein the person will have a rod to use in developing a rhythm of running and a coordination between the various parts of the body as the jogger moves. In addition, the rod 10 provides the jogger with a simple means for storing and carrying items of a personal nature and provides such jogger with a simple and effective means of self protection.

It should be understood by those skilled in the art of jogging equipment that other forms of the invention may be had, all coming within the spirit of the invention and scope of the appended claims.

What is claimed is as follows:

1. A jogger's rod comprising:

an enlarged, hollow spherically shaped rigid body, the interior of which defines a compartment for the storage of personal items, said body having diametrically opposed apertures having smaller diameters than the spherically shaped body which are sized to permit access to said compartment and to permit the passage therethrough of said personal items for storage in said compartment;

a pair of elongated arm members extending perpendicularly from and enclosing said apertures and sized to be grasped by the user's hands on either side of said body, said arm members having a diameter less than the diameter of the spherically shaped body; and means for releasably securing said arm members to said body apertures.

2. The rod defined in claim 1 wherein said arm members and body are made from a material selected from a group consisting of wood, plastic, or hard rubber.

3. The rod defined in claim 1 wherein said securing means comprises threaded surfaces on said body apertures and corresponding threaded surfaces on one end of each of said arm members such that the arm members are threadedly received in said threaded surfaces of said body apertures to secure said arm members thereto.

4. The jogger's rod of claim 1 wherein each elongated arm member comprises an enlarged bulbous region adapted to be secured to the spherically shaped body and a cylindrical region continuously attached to and extending outward perpendicularly from the enlarged bulbous region opposed to the spherical shaped body, said bulbous region having a diameter equal to said apertures and said cylindrical region having a diameter less than said bulbous region.

5. The jogger's rod of claim 4 wherein the longitudinal axis of each elongated arm is approximately equal to the diameter of the spherically shaped body and the diameter of the bulbous region of each arm is less than 50 percent of the diameter of the spherically shaped body.

* * * * *